US009012381B2

(12) United States Patent
Hayama et al.

(10) Patent No.: US 9,012,381 B2
(45) Date of Patent: Apr. 21, 2015

(54) LUBRICANT COMPOSITION USING IONIC LIQUID AS A BASE OIL AND HAVING EXCELLENT RUST PREVENTION PROPERTIES

(75) Inventors: Makoto Hayama, Fujisawa (JP); Setsuo Sasaki, Fujisawa (JP)

(73) Assignee: Kyodo Yushi Co., Ltd., Kanagawa (JP)

( * ) Notice: Subject to any disclaimer, the term of this patent is extended or adjusted under 35 U.S.C. 154(b) by 0 days.

(21) Appl. No.: 13/814,354

(22) PCT Filed: Aug. 8, 2011

(86) PCT No.: PCT/JP2011/068049
§ 371 (c)(1),
(2), (4) Date: Feb. 5, 2013

(87) PCT Pub. No.: WO2012/018137
PCT Pub. Date: Feb. 9, 2012

(65) Prior Publication Data

US 2013/0137615 A1 May 30, 2013

(30) Foreign Application Priority Data

Aug. 6, 2010 (JP) ..... 2010-177775

(51) Int. Cl.

| | |
|---|---|
| ***C07C 317/22*** | (2006.01) |
| ***C07D 207/26*** | (2006.01) |
| ***C07D 233/14*** | (2006.01) |
| ***C07F 9/24*** | (2006.01) |
| ***C10M 173/02*** | (2006.01) |
| ***C10M 105/74*** | (2006.01) |
| ***C10M 171/00*** | (2006.01) |
| ***C10M 105/70*** | (2006.01) |

(52) U.S. Cl.

CPC ..... *C10M 105/74* (2013.01); *C10M 171/00* (2013.01); *C10M 2207/125* (2013.01); *C10M 2215/02* (2013.01); *C10M 2215/023* (2013.01); *C10M 2215/2203* (2013.01); *C10M 2219/0406* (2013.01); *C10M 2223/0405* (2013.01); *C10M 2223/0603* (2013.01); *C10N 2220/04* (2013.01); *C10N 2230/08* (2013.01); *C10N 2230/12* (2013.01); *C10N 2240/20* (2013.01); *C10N 2240/30* (2013.01); *C10M 105/70* (2013.01); *C10M 2201/062* (2013.01); *C10M 2201/083* (2013.01); *C10M 2201/0873* (2013.01); *C10M 2207/122* (2013.01); *C10M 2207/123* (2013.01); *C10M 2207/282* (2013.01); *C10M 2207/283* (2013.01); *C10M 2207/288* (2013.01); *C10M 2215/221* (2013.01); *C10M 2215/223* (2013.01); *C10M 2215/2245* (2013.01); *C10M 2215/2265* (2013.01); *C10M 2215/28* (2013.01); *C10M 2219/044* (2013.01); *C10M 2223/003* (2013.01); *C10N 2220/023* (2013.01); *C10N 2230/02* (2013.01); *C10N 2230/26* (2013.01); *C10N 2240/60* (2013.01); *C10N 2250/10* (2013.01)

(58) Field of Classification Search

USPC ..... 508/250, 244, 262, 268, 270, 513, 427, 508/283

See application file for complete search history.

(56) References Cited

U.S. PATENT DOCUMENTS

| | | | | |
|---|---|---|---|---|
| 2007/0027038 | A1 | 2/2007 | Kamimura et al. | |
| 2009/0036334 | A1 | 2/2009 | Schwab et al. | |
| 2009/0281008 | A1 | 11/2009 | Fujinami et al. | |
| 2010/0105586 | A1* | 4/2010 | Bodesheim et al. | 508/244 |
| 2011/0007990 | A1 | 1/2011 | Kawamura | |

FOREIGN PATENT DOCUMENTS

| | | |
|---|---|---|
| JP | 50-53249 | 5/1975 |
| JP | 2005-154755 | 6/2005 |
| JP | 2006-291011 | 10/2006 |
| JP | 2007-297287 | 11/2007 |
| JP | 2009-029981 | 2/2009 |
| JP | 2009-242765 | 10/2009 |
| JP | 2009-249585 | 10/2009 |
| JP | 2009-299846 | 12/2009 |
| WO | WO 2005/035702 | 4/2005 |

OTHER PUBLICATIONS

International Search Report for PCT/JP2011/068049, mailed Sep. 6, 2011.
Written Opinion of the International Searching Authority for PCT/JP2011/068049, mailed Sep. 6, 2011.
Supplemental European Search Report dated Jan. 27, 2014, in connection with EP 11814760.

* cited by examiner

*Primary Examiner* — Vishal Vasisth
(74) *Attorney, Agent, or Firm* — Nixon & Vanderhye P.C.

(57) ABSTRACT

The invention provides a lubricant composition containing (A) an ionic liquid having an anion represented by formula 1: $(Rf1\text{-}SO_2)(Rf2\text{-}SO_2)N^-$ or formula 2: $(Rf3)(Rf3)(Rf3)PF_3^-$ wherein Rf1 and Rf2 in formula 1 may be the same or different and are each F, $CF_3$, $C_2F_5$, $C_3F_7$ or $C_4F_9$, and Rf3 in formula 2 may be the same or different and is $CF_3$, $C_2F_5$, $C_3F_7$ or $C_4F_9$; and (B) a fatty acid amine salt in an amount of 0.1 to 5.0 mass %. The lubricant composition of the invention can favorably be used under a high vacuum or an ultra high vacuum, or under high temperatures, and exhibits excellent rust prevention properties.

8 Claims, No Drawings

LUBRICANT COMPOSITION USING IONIC LIQUID AS A BASE OIL AND HAVING EXCELLENT RUST PREVENTION PROPERTIES

This application is the U.S. national phase of International Application No. PCT/JP2011/068049, filed 8 Aug. 2011, which designated the U.S. and claims priority to Japan Application No. 2010-177775, filed 6 Aug. 2010, the entire contents of each of which are hereby incorporated by reference.

TECHNICAL FIELD

The present invention relates to a lubricant composition that can be used under high vacuum or ultra high vacuum conditions and under high temperatures. In particular, the invention relates to a lubricant composition suitable for equipment to be used in outer space (space station), vacuum equipment, semiconductor making equipment (sputtering equipment) and the like to be operated under a high vacuum of 0.1 Pa or less or an ultra high vacuum; and usable at high temperatures, i.e., for the equipment or machines that are heated up to a maximum temperature ranging from 200 to 300° C. where the use of a conventional organic lubricant is impossible in light of its flame retardant properties and thermal stability.

BACKGROUND ART

The performance of lubricating oils and greases (hereinafter inclusively referred to as "lubricant") is largely determined by the properties of the base oil used as the major ingredient when the lubricant is used under high vacuum or ultra high vacuum and high temperatures. For example, the conventional base oils widely used for the lubricant, such as mineral oils, ester type oils, poly α-olefins, alkylphenyl ether type oils and the like, show high vapor pressure. In light of this, it is difficult to use lubricants containing the base oils mentioned above under a high vacuum. Instead, perfluoroalkyl ether (PFAE), tris(2-octyldodecyl)cyclopentane or the like may be used as a base oil with low vapor pressure.

Currently, particular attention has been paid to the ionic liquid as a lubricant base oil having higher resistance to vacuum and higher heat resistance than the above-mentioned base oils (WO 2005/035702, JP 2007-297287 A and JP 2005-154755 A). There are many different types of ionic liquids, most of which exhibit water solubility as is the nature of ionic liquids. However, the water-soluble lubricants are disadvantageous because such lubricants easily dissolve into water to induce leakage and have an adverse effect on rust prevention properties. In consideration of the above, an ionic liquid used as a lubricant base oil is basically required to be insoluble in water. Further, ionic liquids have a negative effect on the rust prevention properties. To overcome the above-mentioned drawback, a variety of rust inhibitors are used as disclosed in JP 2006-291011 A, JP 2009-29981 A, JP 2009-249585 A and JP 2009-242765 A. However, sufficient rust prevention effects cannot be obtained through any of the above references, and all of the aforementioned conventional lubricants are still unsatisfactory.

SUMMARY OF INVENTION

Technical Problem

An object of the invention is to provide a lubricant composition using an ionic liquid as the base oil, which lubricant composition can exhibit excellent rust prevention properties and can be used under high vacuum or ultra high vacuum conditions, or under high temperatures.

Solution to Problem

The invention provides the following lubricant composition:

1. A lubricant composition comprising;

(A) an ionic liquid having an anion represented by formula 1 or formula 2, $$(Rf1\text{-}SO_2)\ (Rf2\text{-}SO_2)\ N^- \quad \text{(formula 1)}$$

$$(Rf3)\ (Rf3)\ (Rf3)\ PF_3^- \quad \text{(formula 2)}$$

wherein Rf1 and Rf2 in formula 1 may be the same or different and are each F, $CF_3$, $C_2F_5$, $C_3F_7$ or $C_4F_9$, and Rf3 in formula 2 may be the same or different and is $CF_3$, $C_2F_5$, $C_3F_7$ or $C_4F_9$, and (B) a fatty acid amine salt in an amount of 0.1 to 5.0 mass %.

2. The lubricant composition as described in the above-mentioned item 1, wherein the ionic liquid has a melting point of −20° C. or less.

3. The lubricant composition as described in the above-mentioned item 1 or 2, wherein the anion of the ionic liquid is at least one selected from the group consisting of bis(perfluoroalkylsulfonyl)imide, (trifluoromethylsulfonyl) (heptafluoropropylsulfonyl)-imide, and tris(perfluoroalkyl)trifluorophosphate.

4. The lubricant composition as described in any one of the above-mentioned items 1 to 3, wherein the anion of the ionic liquid is at least one selected from the group consisting of bis(trifluoromethylsulfonyl)imide, (trifluoromethylsulfonyl) (heptafluoro-propylsulfonyl)imide, and tris(pentafluoroethyl)trifluorophosphate.

5. The lubricant composition as described in any one of the above-mentioned items 1 to 4, wherein the cation of the ionic liquid is at least one selected from the group consisting of imidazolium, pyridinium, pyrazolium, piperidinium, pyrrolidinium, morpholine, pyrrole, phosphonium, quaternary ammonium salts, sulfonium and isooxazolium.

6. The lubricant composition as described in any one of the above-mentioned items 1 to 5, wherein the cation of the ionic liquid is at least one selected from the group consisting of ethylmethyl imidazolium, hexylmethyl imidazolium, methyloctyl imidazolium, butyldimethyl imidazolium; butyl-4-methyl pyridinium; methoxyethyl-methyl piperidium; methoxyethyl-methyl pyrrolidinium; octyltriethyl phosphonium, triethyloctyl phosphonium; and propyldimethyl isooxazolium.

Effects of Invention

The lubricant of the invention has excellent rust prevention properties and can be favorably used within a wide range of temperatures, i.e., from low temperatures to high temperatures, and under a high vacuum of 0.1 Pa or less or an ultra high vacuum, particularly in a vacuum of $10^{-4}$ Pa or less.

DESCRIPTION OF EMBODIMENTS

[Ionic Liquid]

The ionic liquid is used as the base oil for the lubricant composition of the invention. The ionic liquid, which is also called "room temperature molten salt", is a molten salt that assumes a liquid state at room temperatures. The ionic liquid is made of a combination of various anions and cations.

In the ionic liquid used in the invention, the anion is represented by the following formula 1 or formula 2:

$$(Rf1\text{-}SO_2)\ (Rf2\text{-}SO_2)\ N^- \quad \text{(formula 1)}$$

$$(Rf3)\ (Rf3)\ (Rf3)\ PF_3^- \quad \text{(formula 2)}$$

wherein Rf1 and Rf2 in formula 1 may be the same or different and are each F, $CF_3$, $C_2F_5$, $C_3F_7$ or $C_4F_9$, and Rf3 in formula 2 may be the same or different and is $CF_3$, $C_2F_5$, $C_3F_7$ or $C_4F_9$.

The anions represented by foiinula 1 include bis(perfluoroalkylsulfonyl)imide, (trifluoromethylsulfonyl)(heptafluoropropylsulfonyl)imide, bis(fluorosulfonyl)imide and the like. Of the above, bis(perfluoroalkylsulfonyl)imide and (trifluoromethyl-sulfonyl)(heptafluoropropylsulfonyl)imide are preferred. Bis(trifluoromethylsulfonyl)-imide is most preferable.

The anions represented by formula 2 include tris(perfluoroalkyl) trifluorophosphate, bis(perfluoroalkyl)(trifluoromethyl) trifluorophosphate and the like. Of the above, tris(perfluoroalkyl)trifluorophosphate is preferable, and tris (pentafluoro-ethyl)trifluorophosphate is more preferable.

As the anion for constituting the ionic liquid of the invention, bis(perfluoroalkylsulfonyl)imide and (trifluoromethyl-sulfonyl) (heptafluoropropyl-sulfonyl)imide, both represented by formula (1) or tris(perfluoroalkyl) trifluorophosphate represented by formula (2) is preferably used.

In particular, bis(trifluoromethylsulfonyl)imide, (trifluoromethylsulfonyl) (heptafluoropropylsulfonyl)imide, and tris (pentafluoroethyl)trifluorophosphate are preferred.

Bis(trifluoromethylsulfonyl)imide is most preferable.

The cations for constituting the ionic liquid are not particularly limited, and include imidazolium, pyridinium, pyrazolium, piperidinium, pyrrolidinium, morpholine, pyrrole, phosphonium, quaternary ammonium salts, sulfonium, isooxazolium and the like. There are also cations classified into aliphatic amines, alicyclic amines, and pyridines (aromatics).

Specific examples include imidazoliums such as ethylmethyl imidazolium, hexylmethyl imidazolium, methyloctyl imidazolium, butyldimethyl imidazolium and the like; pyridinium such as butyl-4-methyl pyridinium and the like; piperidium such as methoxyethyl-methyl piperidinium and the like; pyrrolidiniums such as methoxyethyl-methyl pyrrolidinium and the like; phosphonium such as octyltriethyl phosphonium, triethyloctyl phosphonium and the like; and isooxazoliums such as propyldimethyl isooxazolium and the like.

As the cation for constituting the ionic liquid of the invention, imidazoliums such as ethylmethyl imidazolium, hexylmethyl imidazolium, methyloctyl imidazolium, butyldimethyl imidazolium and the like; pyrrolidiniums such as methoxyethyl-methyl pyrrolidinium and the like; phosphoniums such as octyltriethyl phosphonium, triethyloctyl phosphonium and the like; and isooxazoliums such as propyldimethyl isooxazolium and the like are preferable.

Of the above, pyrrolidiniums such as methoxyethyl-methyl pyrrolidinium and the like are more preferable.

In particular, 1-(2-methoxyethyl)-1-methyl pyrrolidinium is most preferable.

As for the ionic liquid, the following combinations of anions and cations are preferable.

TABLE 1

| Anions | Cations |
|---|---|
| Bis(trifluoromethylsulfonyl)imide | 1-butyl-2,3-dimethyl imidazolium |
| Bis(trifluoromethylsulfonyl)imide | 1-(2-methoxyethyl)-1-methyl pyrrolidinium |
| Bis(trifluoromethylsulfonyl)imide | Triethyloctyl phosphonium |
| (Trifluoromethylsulfonyl) (heptafluoropropylsulfonyl)imide | 1-ethyl-3-methyl imidazolium |

Preferably, the ionic liquid has a melting point of −20° C. or less. Typically, most ionic liquids show a tendency to lose fluidity and solidify at low temperatures, which is not suitable for use at low temperatures. However, by using as the base oil any of the ionic liquids showing fluidity at −20° C. or less without becoming solid, the resultant lubricant compositions can be used within a wide range of temperatures, i.e., from high temperatures to low temperatures. The melting point of the ionic liquid herein used is a melting point at atmospheric pressure, which is determined in accordance with differential scanning calorimetry (DSC).

[Fatty Acid Amine Salt]

In the invention, the fatty acid amine salt is used as a rust inhibitor for the lubricant.

The fatty acid amine salts that can be used in the invention include salts of fatty acids having 1 to 22 carbon atoms, preferably 1 to 20 carbon atoms, with amines. The fatty acids may be saturated or unsaturated, and straight-chain or branched. The amines may be primary, secondary or tertiary amines, having as a functional group an aliphatic group, an alicyclic group or an aromatic group.

According to the invention, the sulfonates, fatty acid amides, compounds having two or more nitrogen atoms, succinic acid esters, succinic acid half esters, nitrites, molybdates, salts of dibasic acids and the like, which are conventionally used as rust inhibitors for lubricant compositions are insufficient in terms of rust prevention performance. In fact, rust appeared. In addition, the above-mentioned conventional sulfonates, nitrites, molybdates and salts of dibasic acids do not dissolve in the ionic liquid. In fact, sedimentation and separation were recognized.

The content of the fatty acid amine salt is 0.1 to 5.0 mass % of the lubricant composition according to the invention. When a content is less than 0.1 mass %, the rust prevention performance is not satisfactory. With the content of more than 5.0 mass %, further improved rust prevention performance may not be expected. The fatty acid amine salt may preferably be contained in an amount of 0.5 to 5.0 mass %.

[Thickener]

The lubricant composition of the invention may be made semi-solid by the addition of a thickener. Any thickener may be used so long as the mixture of the ionic liquid and the fatty acid amine salt can be made into a semi-solid state by the addition of the thickener. For example, every grease thickener hitherto known can be used. Specific examples of the thickener include soap type thickeners such as lithium soap, calcium soap, sodium soap and the like; complex soap type thickeners such as lithium complex soap, calcium complex soap, aluminum complex soap, calcium sulfonate complex soap and the like; urea thickeners such as diurea, tetraurea and the like; organic thickeners such as polytetrafluoroethylene (PTFE), MCA, carbon black and the like; inorganic thickeners such as organoclay, fine silica and the like.

In addition to the known grease thickeners, inorganic fine particles of metals such as copper, silver and the like, metallic oxides such as zinc oxide, titanium oxide and the like, and nitrides such as boron nitride and the like can be used as the thickener in the invention because those inorganic fine particles are substances capable of making the mixture of the ionic liquid and the fatty acid amine salt semi-solid.

The thickener may be contained in an effective amount that can make the lubricant composition into a semi-solid substance, preferably in an amount of 1 to 50 mass %, and more preferably 3 to 30 mass %, based on the total mass of the lubricant composition.

[Additives]

The lubricant composition of the invention may further comprise additives commonly used for typical lubricant compositions. Examples of the additives include an antioxidant, a load carrying additive, a metal corrosion inhibitor and the like. Other rust inhibitors than those mentioned above may be used in combination therewith.

EXAMPLE 1

To prepare lubricant compositions according to Examples and Comparative Examples, a fatty acid amine salt (B) was added to an ionic liquid (A) so that the content of the fatty acid amine salt (B) might be 1.0 mass % of the resultant lubricant composition. The obtained mixture was heated to 70° C. with stirring to prepare each composition. The ionic liquids (A) and the fatty acid amine salts (B) used for the preparation of the lubricant compositions are shown in Table 1.

The obtained lubricant compositions were subjected to the following tests. The results are shown in Table 2.

[Test Methods]

(1) Water Insolubility

Each ionic liquid was added to water at a ratio (by volume) of 0.1:1, and the resultant mixture was stirred. It was visually inspected whether the ionic liquid was insoluble in water or not. The ionic liquid and water were both adjusted to 25° C.

o: water insolubility (insoluble in water)

x: water solubility (soluble in water)

(2) Rust Prevention Properties

A humidity cabinet test was conducted in accordance with JIS K2246.

Test conditions (same as specified in the standard):

Temperature: 49° C.

Humidity: 95% RH

Test period: 14 days

Test piece: changed from the specified SPCC steel plate to a stainless steel plate (SUS440C).

o: Acceptable=No rust generation (Grade A)

Δ: Unacceptable=Degree of rust generation: 1 to 50% (Grade B to Grade D)

x: Unacceptable=Degree of rust generation: 51 to 100% (Grade E)

(3) Low Temperature Fluidity

The low temperature fluidity was assessed by measuring the kinetic viscosity at −20° C. according to JIS K2283.

o: Acceptable=less than 7000 $mm^2/s$ (having low temperature fluidity)

x: Unacceptable=7000 $mm^2/s$ or more (having no low temperature fluidity)

TABLE 2

| | | | |
|---|---|---|---|
| (A) Ionic Liquids | Anions | A | Bis(trifluoromethylsulfonyl)imide ($(CF_3SO_2)_2N^-$: formula 1) |
| | | B | (Trifluoromethylsulfonyl)(heptafluoropropylsulfonyl) imide ($(CF_3SO_2)(C_3F_7SO_2)N^-$: formula 1) |
| | | C | Tris(pentafluoroethyl)trifluorophosphate ($(C_2F_5)_3PF_3$: formula 2) |
| | | D | Tetrafluoroborate ($BF_4$) |
| | | E | Hexafluorophosphate ($PF_6$) |
| | | F | Trifluoromethylsulfonic acid ($CF_3SO_3$) |
| | Cations | A | 1-ethyl-3-methyl imidazolium |
| | | B | 1-hexyl-3-methyl imidazolium |
| | | C | 1-butyl-2,3-dimethyl imidazolium |
| | | D | 1-(2-methoxyethyl)-1-methyl pyrrolidinium |
| | | E | Propyldimethyl isooxazolium |
| | | F | Triethyloctyl phosphonium |
| (B) Rust Inhibitors | | A | Fatty acid amine salt (Cheleslite T (trade name), made by Chelest Corporation) |
| | | B | Fatty acid amine salt (V.C.I.220 (trade name), made by Chelest Corporation) |
| | | C | Sulfonate |
| | | D | Sorbitan trioleate |
| | | E | Beef tallow fatty acid alkanolamide |
| | | F | Benzotriazole derivative |
| | | G | Succinic acid ester |
| | | H | Succinic acid half-ester |
| | | I | Sodium molybdate |
| | | J | Sodium nitrite |
| | | K | Sodium sebacate |
| | | L | Tetradecylamine acetate (NISSANCATION MA (trade name), made by NOF Corporation) |
| | | M | Octadecylamine acetate (NISSANCATION SA (trade name), made by NOF Corporation) |

TABLE 3

| Example No. | | 1 | 2 | 3 | 4 | 5 | 6 | 7 | 8 | 9 | 10 | 11 |
|---|---|---|---|---|---|---|---|---|---|---|---|---|
| Ionic Liquid | Anion | A | A | A | A | A | B | C | A | A | A | A |
| | Cation | A | C | D | E | F | A | B | D | F | F | F |
| Rust inhibitor | | A | A | A | A | A | A | A | B | B | L | M |
| Melting point of ionic liquid (° C.) | | −14 | −20> | −20> | −20> | −20> | −20> | −20> | −20> | −20> | −20> | −20> |
| Water insolubility | | o | o | o | o | o | o | o | o | o | o | o |
| Rust prevention properties (humidity cabinet test) | | o | o | o | o | o | o | o | o | o | o | o |
| Low temp. fluidity (kinetic viscosity at −20° C.) | | x | o | o | o | o | o | o | o | o | o | o |

TABLE 3-continued

| Comparative Example No. | | 1 | 2 | 3 | 4 |
|---|---|---|---|---|---|
| Ionic liquid | Anion | D | E | D | F |
| | Cation | A | A | B | C |
| Water insolubility | | x | x | x | x |

| Comparative Example No. | | 5 | 6 | 7 | 8 | 9 | 10 | 11 | 12 | 13 | 14 |
|---|---|---|---|---|---|---|---|---|---|---|---|
| Ionic Liquid | Anion | A | A | A | A | A | A | A | A | A | A |
| | Cation | D | D | D | D | D | D | D | D | D | D |
| Rust inhibitor | | — | C | D | E | F | G | H | I | J | K |
| Melting point of ionic liquid (° C.) | | −20> | −20> | −20> | −20> | −20> | −20> | −20> | −20> | −20> | −20> |
| Water insolubility | | ○ | ○ | ○ | ○ | ○ | ○ | ○ | ○ | ○ | ○ |
| Rust prevention properties (humidity cabinet test) | | x | x | x | x | x | x | x | Δ | x | x |
| Low temp. fluidity (kinetic viscosity at −20° C.) | | ○ | ○ | ○ | ○ | ○ | ○ | ○ | ○ | ○ | ○ |

The lubricant compositions of Examples 1 to 9 exhibited water insolubility and excellent rust prevention properties. As can be seen from the kinetic viscosities of less than 7000 $mm^2/s$ at −20° C., the lubricant compositions of Examples 2 to 9 ensured sufficient, fluidity at the low temperature of −20° C. and demonstrated the possibility to work even at −20° C.

In contrast to this, the lubricant compositions of Comparative Examples 1 to 4 showed that they were water-soluble and not suitable as lubricants.

The lubricant compositions of Comparative Examples 5 to 14 contained ionic liquids having any anion of formula 1 or 2. Without the rust inhibitor (Comparative Example 5), the rust prevention properties were insufficient and the obtained lubricant composition was found to be unsuitable for the use under an ultra high vacuum or high temperatures although the water insolubility was ensured. As can be seen from Comparative Examples 6 to 14, when the rust inhibitor was chosen from the group effective for commonly used petroleum type lubricants (not including the fatty acid amine salts), the rust prevention properties were inferior and the obtained lubricant compositions were found to be unsuitable for the use under a high vacuum or an ultra high vacuum, or high temperatures.

The invention claimed is:

1. A lubricant composition comprising;

(A) an ionic liquid having an anion represented by formula 1 or formula 2:

$$(Rf1\text{-}SO_2)\ (Rf2\text{-}SO_2)\ N^- \quad \text{(formula 1)}$$

$$(Rf3)\ (Rf3)\ (Rf3)\ PF_3^- \quad \text{(formula 2)}$$

wherein Rf1 and Rf2 in formula 1 may be the same or different and are each F, $CF_3$, $C_2F_5$, $C_3F_7$ or $C_4F_9$, and Rf3 in formula 2 may be the same or different and is $CF_3$, $C_2F_5$, $C_3F_7$ or $C_4F_9$, and (B) a fatty acid amine salt in an amount of 0.1 to 5.0 mass %, wherein the ionic liquid has a melting point of −20° C. or less, and wherein the anion of the ionic liquid is at least one selected from the group consisting of bis(perfluoroalkylsulfonyl)imide, (trifluoromethylsulfonyl)(heptafluoropropylsulfonyl)imide, and tris(perfluoroalkyl)trifluorophosphate, and wherein the cation of the ionic liquid is at least one selected from the group consisting of ethylmethyl imidazolium, butyldimethyl imidazolium; and propyldimethyl isooxazolium.

2. The lubricant composition of claim 1, wherein the anion of the ionic liquid is at least one selected from the group consisting of bis(trifluoromethylsulfonyl)imide, (trifluoromethylsulfonyl)(heptafluoropropylsulfonyl) imide, and tris (pentafluoroethyl)trifluorophosphate.

3. The lubricant composition of claim 1, further comprising a thickener.

4. The lubricant composition comprising:

(A) an ionic liquid selected from the group consisting of:

1-butyl-2,3-dimethyl imidazolium bis(trifluoromethylsulfonyl)imide, 1-(2-methoxyethyl)-1-methyl pyrrolidinium bis(trifluoromethylsulfonyl)imide, triethyloctyl phosphonium bis (trifluoromethylsulfonyl)imide, and 1-ethyl-3-methyl imidazolium (trifluoromethylsulfonyl) (hepta-fluoropropylsulfonyl) imide, and (B) a fatty acid amine salt in an amount of 0.1 to 5.0 mass %.

5. The lubricant composition of claim 1, wherein the amine is primary, secondary or tertiary amines, having as a functional group an aliphatic group or an aromatic group.

6. The lubricant composition of claim 5, wherein the fatty acid amine salt is a salt of a fatty acid having 1 to 22 carbon atoms and an amine.

7. The lubricant composition of claim 4, further comprising a thickener.

8. The lubricant composition of claim 4, wherein the amine is primary, secondary or tertiary amines, having as a functional group an aliphatic group or an aromatic group.

* * * * *